United States Patent [19]

Kramer

[11] 3,955,224

[45] May 11, 1976

[54] SEAT CONSTRUCTION

[75] Inventor: Milton H. Kramer, Wyncote, Pa.

[73] Assignee: D S C Industries, Inc., Philadelphia, Pa.

[22] Filed: Mar. 5, 1975

[21] Appl. No.: 555,544

[52] U.S. Cl. ..... 5/347; 5/159 V

[51] Int. Cl.[2] ..... A47C 23/00

[58] Field of Search ..... 5/159 V, 347, 345; 297/180, 453, 451, 452

[56] References Cited

UNITED STATES PATENTS

| | | | |
|---|---|---|---|
| 1,843,893 | 2/1932 | Becher | 5/347 X |
| 3,331,089 | 7/1967 | Ornas, Jr. et al. | 5/347 |
| 3,844,613 | 10/1974 | Waldorf | 297/452 |

*Primary Examiner*—Paul R. Gilliam
*Assistant Examiner*—Andrew M. Calvert
*Attorney, Agent, or Firm*—Edelson and Udell

[57] ABSTRACT

A cushioned seat structure comprising a resiliently compressible foam cushion having a pair of channel formations opening through the bottom face of the cushion and extending upward for a distance into the cushion body but terminating short of the cushion top face, the channels extending widthwise of the cushion along lines parallel to and spaced rearward from the cushion front face, one channel being spaced about midway back and the other channel being spaced roughly three quarters rearward. Underlying the cushion is a rigid support platform having a pair of slots therethrough aligned with the cushion channels where they open through the cushion bottom face, the slots being substantially congruent with the channels openings. The cushion lower surface is adhesively secured to the platform upper surface to prevent relative slippage in order to keep the cushion material out of the slots. A depending skirt portion of the cushion surrounds and cushions the side edges of the platform.

17 Claims, 6 Drawing Figures

FIG. 1
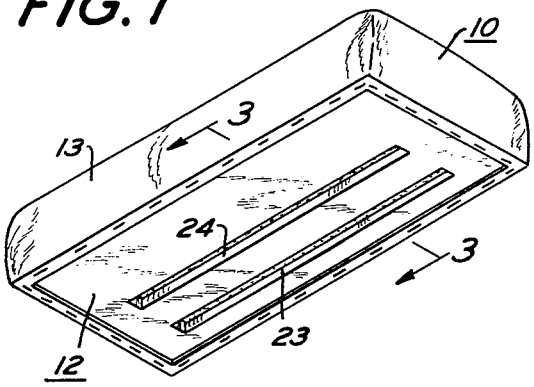
FIG. 2
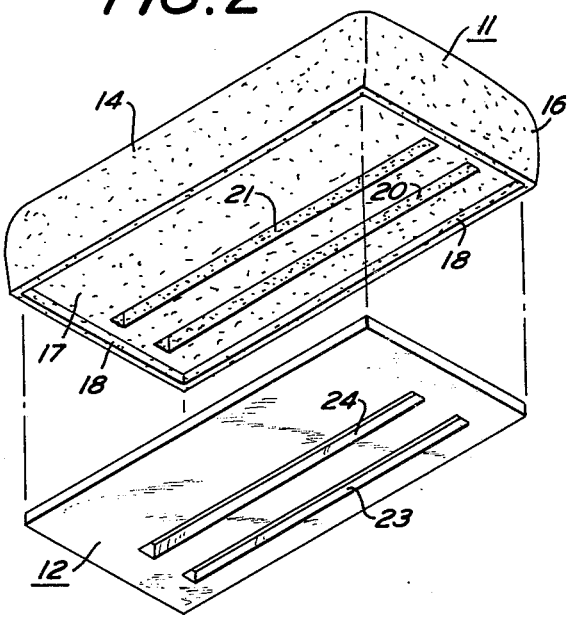
FIG. 3
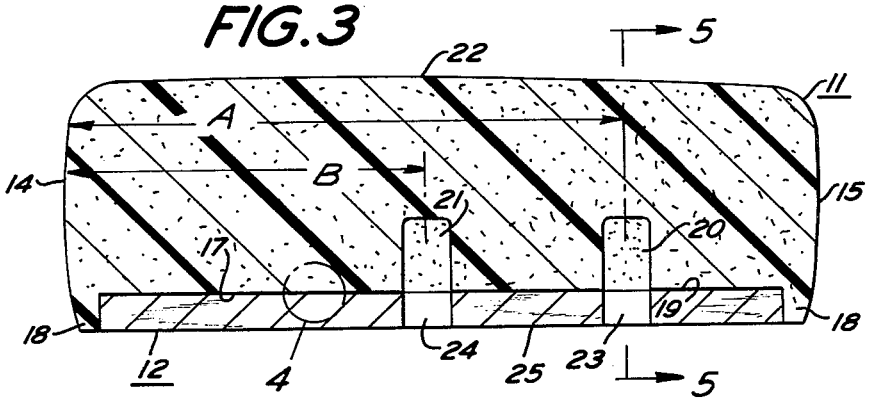
FIG. 4
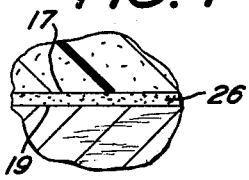
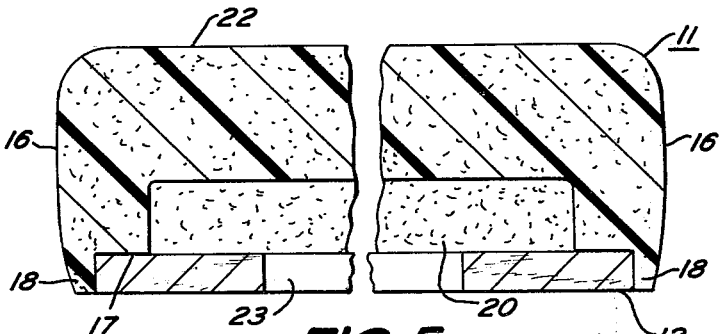
FIG. 5
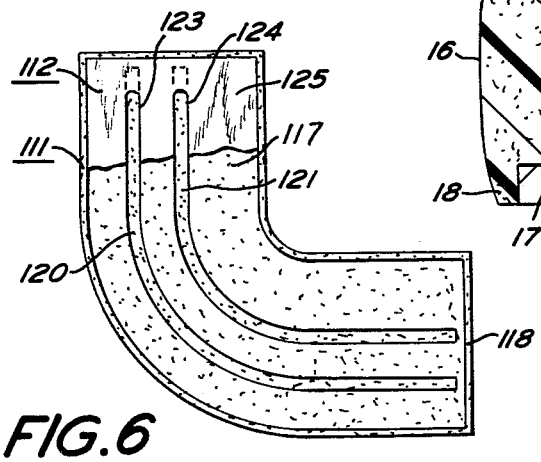
FIG. 6

SEAT CONSTRUCTION

This invention relates generally to seat constructions, and more particularly relates to cushioned seats of the type having a relatively rigid support member upon which is disposed a foamed plastic or foamed rubber cushion covered by a fabric of cloth, plastic or the like.

Foamed cushion seat constructions are per se not new, but such cushions have in the past been characterized by a number of problems evidenced by a lack of seating comfort. In general the cause of the lack of seating comfort has not been readily ascertainable, and various expedients have been attempted in order to improve upon the result. Some of the problems which have been encountered are seating characteristics in which the seats are too hard so that they feel like boards, too soft so that a person tends to be enveloped in the cushion, wrinkle-edged, and the uncomfortable condition in which an occupant seated on a cushion is tilted forward, backward or laterally.

Briefly, the seat construction according to the invention solves the aforedescribed seating comfort problems by means of a novel structure which combines the characteristics of a special support surface with a cushion of foamed material having indentation load deflection characteristics in a certain range, and which is formed in specified regions of the seat with a novel pressure relief construction resulting in controlled deformation of the seat cushion by the weight of an occupant such that the previously described problems are eliminated.

It is a primary object of the invention to provide a novel seat construction utilizing a foamed cushion supported on a rigid platform and utilizing a novel pressure relief configuration formed conjointly by the support platform and a portion of the foamed cushion.

Another object of the invention is to provide a novel seat construction as aforesaid wherein the foamed cushion is formed with channels extending upward from the bottom surface of the cushion and widthwise thereof, such channels being located within set limits at specific distances from the front edge of the cushion.

A further object of the invention is to provide a novel seat construction as aforesaid wherein the support platform underlying the foamed cushion is provided with slot formations directly underlying the channel formations in the cushion so that air disposed within the cushion channels can be readily exhausted through the platform slots when the cushion is subjected to vertical compression.

Yet another object of the invention is to provide a novel seat construction as aforesaid wherein the engaging surfaces of the seat platform and the abovelying foamed cushion are secured in an anti-slip relationship so that portions of the cushion adjacent to the channels cannot migrate or be pressed into the platform slots so that the channel air exhaust structure is maintained continuously operative.

The foregoing and other objects of the invention will become clear from a reading of the following specification in conjunction with an examination of the appended drawings, wherein:

FIG. 1 is a perspective view of the seat construction according to the invention viewed from below;

FIG. 2 is a perspective view of the seat construction according to the invention similar to that shown in FIG. 1 but with the cover removed and with the cushion separated from the support platform;

FIG. 3 is a cross-sectional view, on an enlarged scale, taken through the seat shown in FIG. 1 and with the cover removed, as would be seen when viewed along the line 3—3 of FIG. 1;

FIG. 4 is an enlarged fragmentary view of a portion of the seat shown enclosed in the phantom circle designated as 4 in FIG. 3;

FIG. 5 is a longitudinal sectional view through the seat structure as would be seen when viewed along the line 5—5 of FIG. 3; and FIG. 6 is a bottom plan view of a seat construction according to the invention as embodied in a 90° curved seat structure, a portion of the support platform being broken away to disclose the cushion configuration.

In the several figures, like elements are denoted by like reference characters.

Considering now the drawings, in FIG. 1 there is shown an assembled seat construction designated generally as 10, and consisting of, as best seen in FIG. 2, a foam cushion designated as 11 and an underlying support platform designated generally as 12, the cushion 11 being enclosed by a covering 13 which is secured on the underside of the platform 12. The cushion 11 is generally rectangular having a front face 14, a rear face 15, a pair of opposite side faces 16 and a bottom face 17. The lower marginal edges of the front, rear and side faces of the cushion extend downward below the plane of the bottom face 17 to form a peripherally extending skirt 18 within which is close fittingly disposed the support platform 12 with the upper surface 19 of the support platform being surface engaged with the entire bottom face 17 of the foam cushion 11. The skirt 18 provides a soft cushion about the side edges of the platform 12.

As best seen in FIG. 3, molded or otherwise formed in the cushion 11 are a pair of widthwise extending channels 20 and 21 which extend upward into the body of the cushion from the bottom face 17, the channels terminating inwardly of the side faces 16 as best seen in FIGS. 2 and 5. A typical foam cushion according to the invention would be substantially 19½ inches between the front and rear faces 14 and 15 with a cushion depth from the top face 22 to the bottom face 17 of substantially 4 to 6 inches. Assuming that the aforesaid typical foamed cushion is formed so that utilizing ASTM test method D2406-68 an indentation load deflection is obtained of $35 \pm 5$ pounds, each of the channels 20 and 21 should have cross sectional dimensions of substantially 2 inches in height and 1¼ inches in width. If a foam of softer ILD is used, then the channels 20 and 21 would have to be of smaller cross section, but if the foam is too soft, then the invention cannot be utilized since the cushion will collapse. If a denser ILD foam is used, then the channels 20 and 21 will have to be of enlarged cross section in order to maintain the same seating characteristics.

It has been found that for a cushion as described, the center of channel 20 should be located a distance A from the front face 14 of substantially 14½ inches with a variation of not more than about 1 inch. Similarly, channel 21 should be located from the cushion front face 14 a distance B inches of substantially 9½ inches with a range also of not more than approximately 1 inch. Moreover, both of the dimensions A and B should be moved in the same direction rather than in opposite directions, that is, if the A dimension is decreased to move it closer to the front face, the B dimension should not be increased to move it away from the front face.

The dimensions A and B are significant in that if the channels 20 and 21 are moved too far forward, the front portion of the cushion tends to collapse thereby tilting the seat occupant forward. Similarly, if the channels 20 and 21 are moved too far toward the rear face of the cushion, the rear of the seat tends to collapse thereby tilting the seat occupant backward. The optimum configuration appears to be substantially as hereinbefore described.

The support platform 12, which typically may be made of plywood or high density flake board, is provided with slots 23 and 24 extending completely through the support platform 12 from the upper surface 19 to the lower surface 25, the slots 23 and 24 being of the same width as the cushion channels 20 and 21 and being vertically aligned respectively with such channels as best seen in FIG. 3. The slots 23 and 24 are somewhat shorter in length than the corresponding overlying channels 20 and 21 of the foam cushion, as best seen in FIG. 5, because extension of the slots too close to the side edges of the support platform 12 causes an unacceptable weakening of the platform structurally, and it is also necessary to extend the channels 20 and 21 closer to the cushion side faces 16 in order to prevent the cushion from becoming unduly stiff on the ends.

As best seen in FIG. 4, the bottom face of the foam cushion 11 is secured, as by an adhesive 26, to the upper surface of the support platform 12 in order to mechanically stabilize the cushion and platform with respect to one another and prevent sliding movement of the cushion with respect to the platform. Sliding movement between the cushion and platform causes ultimate deformation of the cushion and can cause portions of the cushion adjacent to the channels 20 and 21 to be pushed downward into the slots 23 and 24 to thereby destroy the controlled compression characteristics of the seat which are attributable to the presence of the channels 20 and 21.

The principles of the invention are applicable to seats having other than straight rectangular configurations, such as is shown in the 90° curved seat illustrated in bottom plan view in the showing of FIG. 6. As shown, the reference characters applied to this seat configuration are identical to the corresponding parts shown in FIGS. 1 to 5 except that they are prefaced by the numeral 1. That is, the curved cushion 111 is provided with a support platform shown fragmentarily as 112, the cushion 111 having the bottom face 117 with a peripherally extending skirt 118, with channels 120 and 121 extending upward from the bottom surface of the cushion. The lower surface 125 of the support platform 112 is shown as having cut therethrough in registry with the channels 120 and 121 a pair of slots 123 and 124. The curved seat illustrated in FIG. 6 functions in identically the same way as the straight seat shown in the other figures, and the dimensions applicable to the straight seat of FIGS. 1 to 5 are likewise applicable to the configuration of FIG. 6.

Having now described my invention in connection with a particularly illustrated embodiment thereof, modifications and variations of the invention may naturally occur from time to time to those persons normally skilled in the art without departing from the essential scope or spirit of the invention, and accordingly it is intended to claim the same broadly as well as specifically as indicated by the appended claims.

What is claimed to be new and useful is:

1. A cushioned seat structure comprising in combination, a. a resiliently compressible foam cushion having top, bottom, front, rear and side faces, and at least one cavity opening through the bottom face of said cushion and extending upward therefrom for a distance into the body of said cushion but terminating short of said top face, said at least one cavity extending widthwise of said cushion along a line substantially parallel to the said cushion front face and spaced farther therefrom than from the said cushion rear face, and b. an underlying cushion support platform having upper and lower surfaces with said cushion bottom face being seated flatwise upon said support platform upper surface, and at least one aperture completely through said support platform from the said upper surface to the said lower surface, said at least one aperture being aligned with said at least one cushion cavity where it opens through the said cushion bottom face and being of sufficient cross sectional area to permit free movement of air therethrough, whereby, seating pressure upon the top face of said cushion causes exhaustion of air in said cushion at least one cavity through the said at least one aperture in said support platform.

2. A seat structure as defined in claim 1 further including antislip means effective to prevent relative movement between said cushion bottom face and said support platform upper surface to thereby prevent movement of the cushion material adjacent to said at least one cushion cavity from intruding into said support platform at least one aperture.

3. A seat structure as defined in claim 1 further including an adhesive bond between said cushion bottom face and said support platform upper surface effective to prevent relative movement between said cushion bottom face and said support platform upper surface to thereby prevent movement of the cushion material adjacent to said at least one cushion cavity from intruding into said support platform at least one aperture.

4. A seat structure as defined in claim 1 wherein said at least one aperture is substantially congruent with said at least one cushion cavity where it opens through the said cushion bottom face.

5. A seat structure as defined in claim 1 wherein said at least one cushion cavity comprises an open channel extending widthwise of said cushion but terminating short of each of said cushion side faces.

6. A seat structure as defined in claim 1 wherein said at least one cushion cavity comprises an open channel extending widthwise of said cushion but terminating short of each of said cushion side faces, and wherein said at least one aperture comprises a slot substantially congruent with said open channel where it opens through the said cushion bottom face.

7. A seat structure as defined in claim 1 wherein said at least one cushion cavity comprises an open channel extending widthwise of said cushion but terminating short of each of said cushion side faces, and wherein said at least one aperture comprises a slot substantially congruent with said open channel where it opens through the said cushion bottom face, and further including an adhesive bond between said cushion bottom face and said support platform upper surface effective to prevent relative movement between said cushion bottom face and said support platform upper surface to thereby prevent movement of the cushion material adjacent to said at least one cushion cavity from intruding into said support platform at least one aperture.

8. A seat structure as defined in claim 1 wherein said at least one cavity comprises two independent cavities each opening through the bottom face of said cushion and extending upwardly therefrom for a distance into the body of said cushion but terminating short of said top face, said two independent cavities both extending widthwise of said cushion along lines substantially parallel to the said cushion front face, at least one of said two independent cavities being spaced farther from said cushion front face than from said cushion rear face.

9. A seat structure as defined in claim 1 wherein said at least one cavity comprises two independent cavities each open through the bottom face of said cushion and extending upwardly therefrom for a distance into the body of said cushion but terminating short of said top face, said two independent cavities both extending widthwise of said cushion along lines substantially parallel to the said cushion front face, at least one of said two independent cavities being spaced farther from said cushion front face than from said cushion rear face, and the other of said cavities being spaced approximately at the midpoint between said cushion front and rear faces.

10. A seat structure as defined in claim 5 wherein the centerline of said widthwise extending cavity parallel to said cushion front face is spaced substantially 14½ inches from said front face.

11. A seat structure as defined in claim 5 further including an adhesive bond between said cushion bottom face and said support platform upper surface effective to prevent relative movement between said cushion bottom face and said support platform upper surface to thereby prevent movement of the cushion material adjacent to said at least one cushion cavity from intruding into said support platform at least one aperture.

12. A seat structure as defined in claim 8 wherein said two independent cavities comprise two open channels extending widthwise of said cushion but terminating short of each of said cushion side faces.

13. A seat structure as defined in claim 8 wherein said two independent cavities comprise two open channels extending widthwise of said cushion but terminating short of each of said cushion side faces, and wherein said at least one aperture comprises two independent slots respectively substantially congruent with said two open channels where the latter open through the said cushion bottom face.

14. A seat structure as defined in claim 9 wherein said two independent cavities comprise two open channels extending widthwise of said cushion but terminating short of each of said cushion side faces, and wherein said at least one aperture comprises two independent slots respectively substantially congruent with said two open channels where the latter open through the said cushion bottom face.

15. A seat structure as defined in claim 14 wherein the centerline of one of said widthwise extending channels parallel to said cushion front face is spaced substantially 14½ inches from said front face.

16. A seat structure as defined in claim 14 wherein the centerline of one of said widthwise extending channels parallel to said cushion front face is spaced substantially 14½ inches from said front face, and wherein the centerline of the other of said widthwise extending channels is spaced substantially 9½ inches from said front face.

17. A seat structure as defined in claim 16 further including an adhesive bond between said cushion bottom face and said support platform upper surface effective to prevent relative movement between said cushion bottom face and said support platform upper surface to thereby prevent movement of the cushion material adjacent to said channels from intruding into said support platform slots.

* * * * *